US007053853B2

(12) United States Patent
Merenda et al.

(10) Patent No.: US 7,053,853 B2
(45) Date of Patent: May 30, 2006

(54) PLANAR ANTENNA FOR A WIRELESS MESH NETWORK

(75) Inventors: Joseph Merenda, Northport, NY (US); Mark J. Rich, Menlo Park, CA (US)

(73) Assignee: SkyPilot Network, Inc., Santa Clara, CA (US)

( * ) Notice: Subject to any disclaimer, the term of this patent is extended or adjusted under 35 U.S.C. 154(b) by 78 days.

(21) Appl. No.: 10/607,405

(22) Filed: Jun. 26, 2003

(65) Prior Publication Data

US 2004/0263390 A1 Dec. 30, 2004

(51) Int. Cl.
*H01Q 9/16* (2006.01)

(52) U.S. Cl. ..... 343/820

(58) Field of Classification Search ..... 343/820, 343/821, 822, 823, 876, 879, 777, 778, 897, 343/893; 455/273, 103
See application file for complete search history.

(56) References Cited

U.S. PATENT DOCUMENTS

| | | | | | |
|---|---|---|---|---|---|
| 4,259,674 | A | | 3/1981 | Dragone et al. | 343/909 |
| 4,602,257 | A | * | 7/1986 | Grisham | 342/25 R |
| 4,728,960 | A | | 3/1988 | Lo | 343/700 MS |
| 4,784,147 | A | | 11/1988 | Moshfeghi | 128/653 |
| 5,181,042 | A | | 1/1993 | Kaise et al. | 343/700 MS |
| 5,210,541 | A | | 5/1993 | Hall et al. | 343/700 MS |
| 5,686,928 | A | | 11/1997 | Pritchett et al. | 343/711 |
| 5,751,248 | A | | 5/1998 | Thaniyavarn | 342/368 |
| 5,832,389 | A | | 11/1998 | Dent | |
| 5,936,592 | A | * | 8/1999 | Ramanujam et al. | 343/853 |
| 6,037,911 | A | | 3/2000 | Brankovic et al. | 343/795 |
| 6,229,486 | B1 | | 5/2001 | Krile | 343/700 MS |
| 6,266,011 | B1 | * | 7/2001 | Hong | 342/375 |
| 6,292,133 | B1 | | 9/2001 | Lynch | 342/368 |
| 6,317,095 | B1 | * | 11/2001 | Teshirogi et al. | 343/785 |
| 6,369,770 | B1 | * | 4/2002 | Gothard et al. | 343/794 |
| 6,407,705 | B1 | | 6/2002 | Sanad | 343/700 MS |
| 6,426,814 | B1 | | 7/2002 | Berger et al. | 359/117 |
| 6,433,742 | B1 | | 8/2002 | Crawford | 343/700 MS |
| 6,438,367 | B1 | | 8/2002 | Crawford | 455/410 |
| 6,456,245 | B1 | | 9/2002 | Crawford | 343/702 |
| 6,583,760 | B1 | * | 6/2003 | Martek et al. | 342/373 |

(Continued)

FOREIGN PATENT DOCUMENTS

| | | |
|---|---|---|
| JP | 01-274505 | 11/1989 |
| JP | 01-279604 | 11/1989 |
| JP | 06-314923 | 11/1994 |
| JP | 2001-244717 | 9/2001 |
| JP | 2001-284951 | 10/2001 |

OTHER PUBLICATIONS

Copy of International Search Report dated Oct. 4, 2004 for corresponding PCT application, PCT/US2004/019427.

*Primary Examiner*—Shih-Chao Chen
*Assistant Examiner*—Minh Dieu A
(74) *Attorney, Agent, or Firm*—Moser, Patterson & Sheridan, LLP

(57) ABSTRACT

A planar antenna that facilitates directional communication to a mesh network. The antenna is housed in a relatively small, planar package that can easily be attached to a window pane to enable the antenna to communicate with a neighboring rooftop mounted node of the mesh network. The package contains an M by N element phased array, where M and N are integers greater than one. The array is driven by microwave signals supplied from a P-angle phase shifting circuit, where P is an integer greater than one. Thus, the antenna synthesizes a single main beam and the antenna's main beam can be electrically "pointed" in one of P directions. In one embodiment of the invention, the array comprises 40 physical elements (8×5 elements) and has three selectable directions (i.e., the phase shifters provide +90, 0 and −90 degree shifts that move the beam left 45 degrees, center and right 45 degrees).

6 Claims, 6 Drawing Sheets

U.S. PATENT DOCUMENTS

| | | | | | |
|---|---|---|---|---|---|
| 6,710,742 | B1 | * | 3/2004 | Meredith | 342/373 |
| 6,756,939 | B1 | * | 6/2004 | Chen et al. | 342/372 |
| 6,765,530 | B1 | * | 7/2004 | Lalezari et al. | 342/375 |
| 6,816,116 | B1 | * | 11/2004 | Chen | 342/372 |
| 2002/0052960 | A1 | | 5/2002 | Trisno et al. | 709/226 |
| 2002/0136062 | A1 | | 9/2002 | Matthews | 343/795 |
| 2002/0137547 | A1 | | 9/2002 | Judson | 455/562 |
| 2002/0175859 | A1 | | 11/2002 | Newberg et al. | 342/375 |
| 2002/0176381 | A1 | | 11/2002 | Hammel et al. | |
| 2002/0181427 | A1 | | 12/2002 | Sparr et al. | |
| 2003/0017851 | A1 | | 1/2003 | Ghavami | 455/562 |
| 2003/0030594 | A1 | | 2/2003 | Larry | 343/895 |
| 2003/0038748 | A1 | | 2/2003 | Henderson et al. | 342/373 |

* cited by examiner

PLANAR ANTENNA FOR A WIRELESS MESH NETWORK

BACKGROUND OF THE INVENTION

1. Field of the Invention

The invention relates generally to wireless networks, and more particularly to antennas for wireless networks.

2. Description of the Related Art

Consumer appetite for access to information continues to grow along with growth of the Internet. Corresponding to such growth, new information is added to the Internet constantly. With respect to multimedia content in particular, much of this information comes at a significant cost in bandwidth.

Telephone dial-up service is being replaced with broader bandwidth systems such as satellite, digital subscriber line (DSL), and cable modem. Unfortunately, these systems are not presently available to a significant portion of the population. Moreover, acquisition and installation costs associated with these systems make them less appealing.

Accordingly, wireless connectivity is on the rise. Wireless systems may be deployed more rapidly with less cost than their wired counterparts. Systems using cellular phone technologies are directed at providing mobile wireless Internet connectivity. Unfortunately, such systems are bandwidth limited.

Alternatives to cellular telephone technologies are point to multi-point (PMP) cellular architectures providing high speed, data only services. Benefits of wireless systems for delivering high-speed services include rapid deployment without overhead associated with installation of local wired distribution networks. Unfortunately, PMP systems rely upon long-range transmissions and a sophisticated customer premise installation.

Another alternative system that provides a fixed wireless solution with bandwidth comparable to DSL and cable modem technologies that is less complex to install and less costly is a mesh network architecture. As described in U.S. patent application Ser. No. 10/122,886, filed Apr. 15, 2002 and application Ser. No. 10/122,762, filed Apr. 15, 2002, which are both incorporated herein by reference, a mesh network comprises a plurality of wirelessly connected nodes that communicate data traffic across a wide area at bandwidths exceeding DSL or cable. The nodes of the mesh communicate with one another using radio or microwave communications signals that are transceived using a roof mounted, directional antenna. Directional antennas are useful in a mesh network because they extend the maximum distance between the mesh nodes and reduce the effects of interfering signals from other nodes and other sources. The disclosed antenna structure uses antenna array technology to provide an antenna that has switched directionality. The antenna's main beam or beams may be pointed in a variety of different directions covering 360 degrees. Such roof top directional antennas are very effective in connecting to neighboring nodes (other roof top antennas) without obstruction.

Although the rooftop antennas provide an optimal solution for interconnecting mesh nodes, in some instances, rooftop access is not available or the user is incapable of installing the antenna on the roof.

Therefore, there is a need in the art for an antenna that enables a user to join a mesh using a non-rooftop mounted antenna, i.e., a window mount or wall mount antenna. Desired features of the window/wall mount antenna include a thin form factor for unobtrusive installation, substantial directivity for long range connectivity, the ability to point the antenna beam to increase signal power or reject interference.

SUMMARY OF THE INVENTION

The present invention is a planar antenna that facilitates directional communication to a mesh network. The antenna is housed in a relatively small, thin, planar package that can easily be attached to a window pane or wall to enable the antenna to communicate with at least one neighboring rooftop mounted node of the mesh network. The package contains an M by N element phased array, where M and N are integers greater than one. The array elements are driven by microwave signals supplied from amplitude and phase shifting circuits. These circuits provide P combinations of phase and amplitude shifts at each element, where P is an integer greater than one, to optimally combine the signals impinging upon each element (or transmitted from each element). Thus, the antenna synthesizes a single main beam and the antenna's main beam can be electrically "pointed" in one of P directions.

Residential communication services require the use of low cost equipment to be economically feasible. The cost of amplitude and phase shifting circuits has prohibited the use of electronically steered antennas in this application. An important feature of this embodiment is its low cost. Low cost has been achieved by minimizing the number of unique amplitudes and unique phase shifts required to synthesize P beams. Further, this embodiment uses phase shifts of +90° and −90° that are easily produced in analog circuitry.

In one embodiment of the invention, the array comprises 40 physical elements (8×5 elements) and has three selectable directions (i.e., left 45 degrees, center and right 45 degrees). These states are accomplished by using fixed amplitudes on each of the 5 columns of antenna elements, and phase shift states of 0°, +90° and −90°.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

Figure 1:
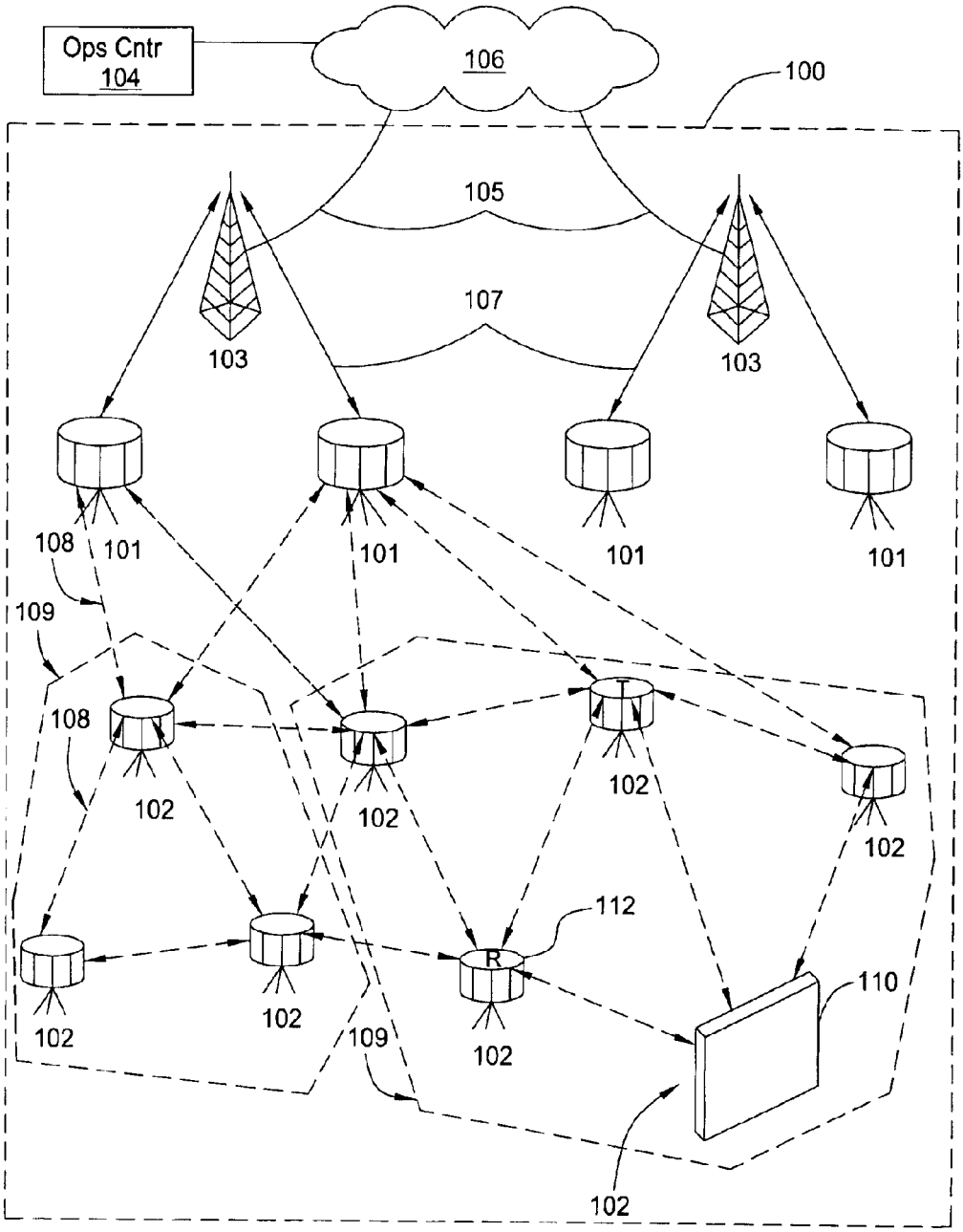
Figure 2A:
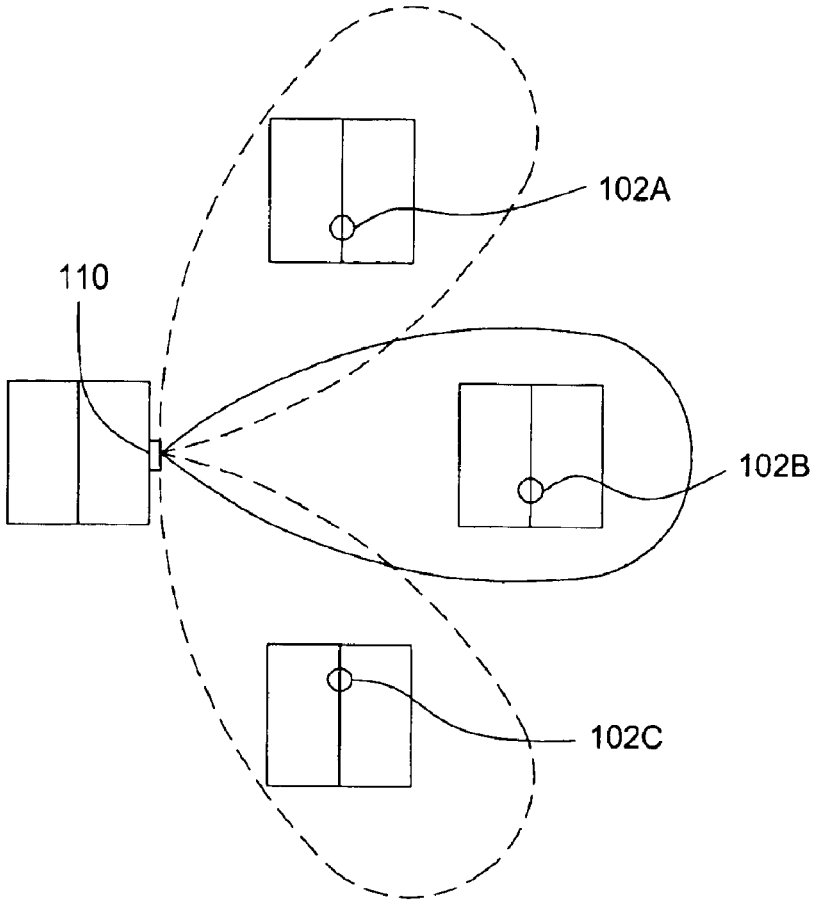
Figure 2B:
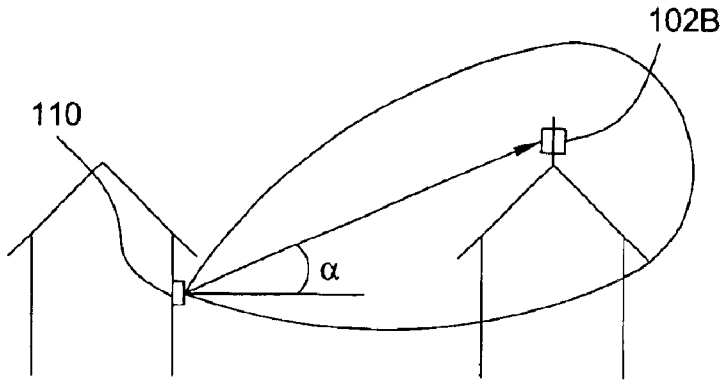
Figure 3:
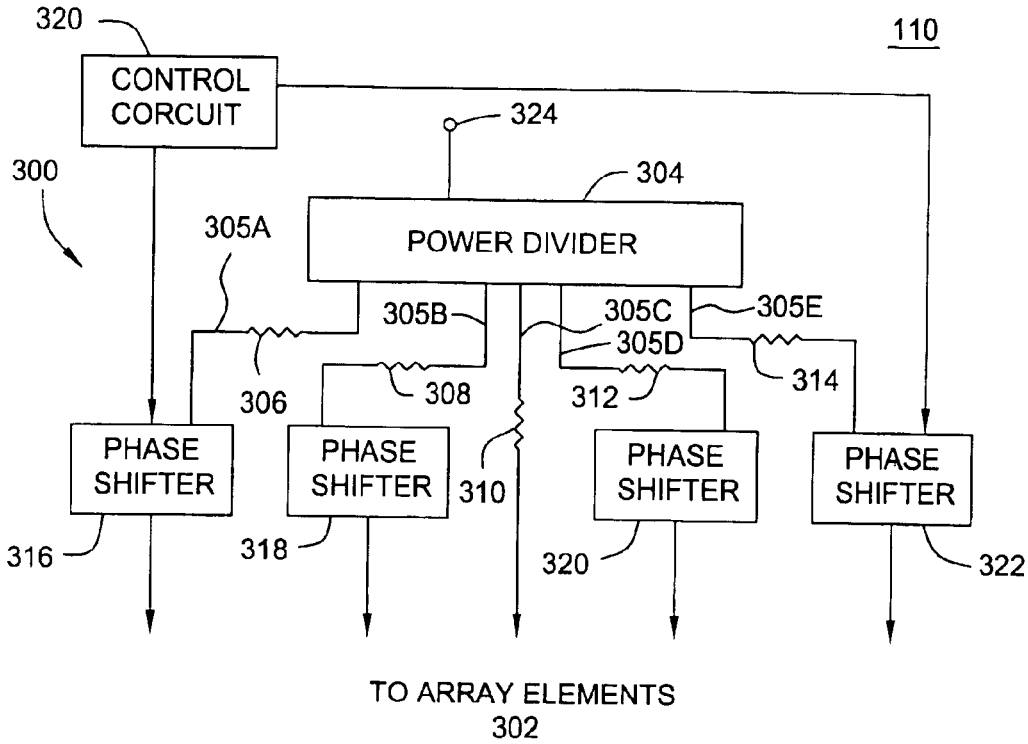
Figure 7:
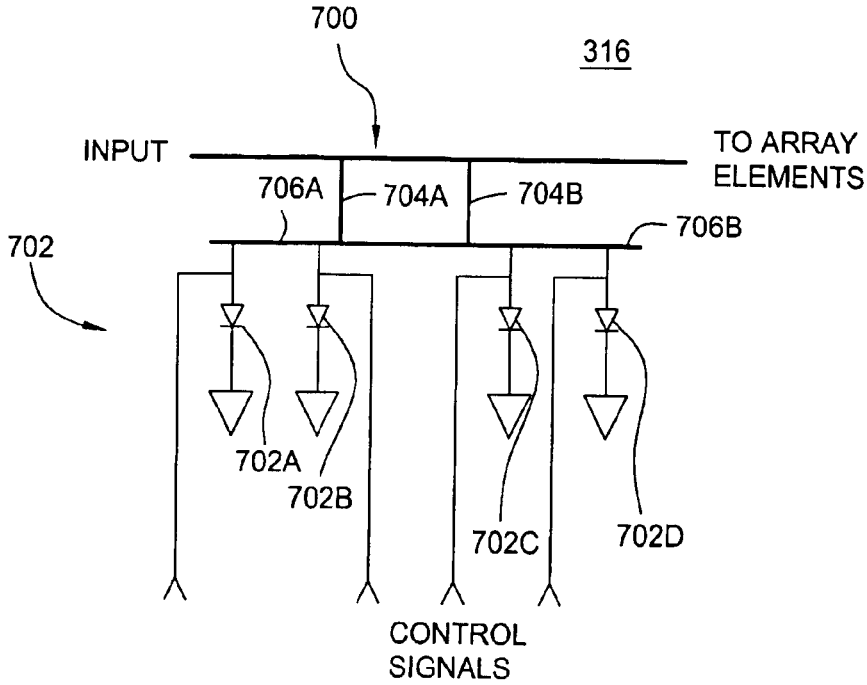
Figure 4:
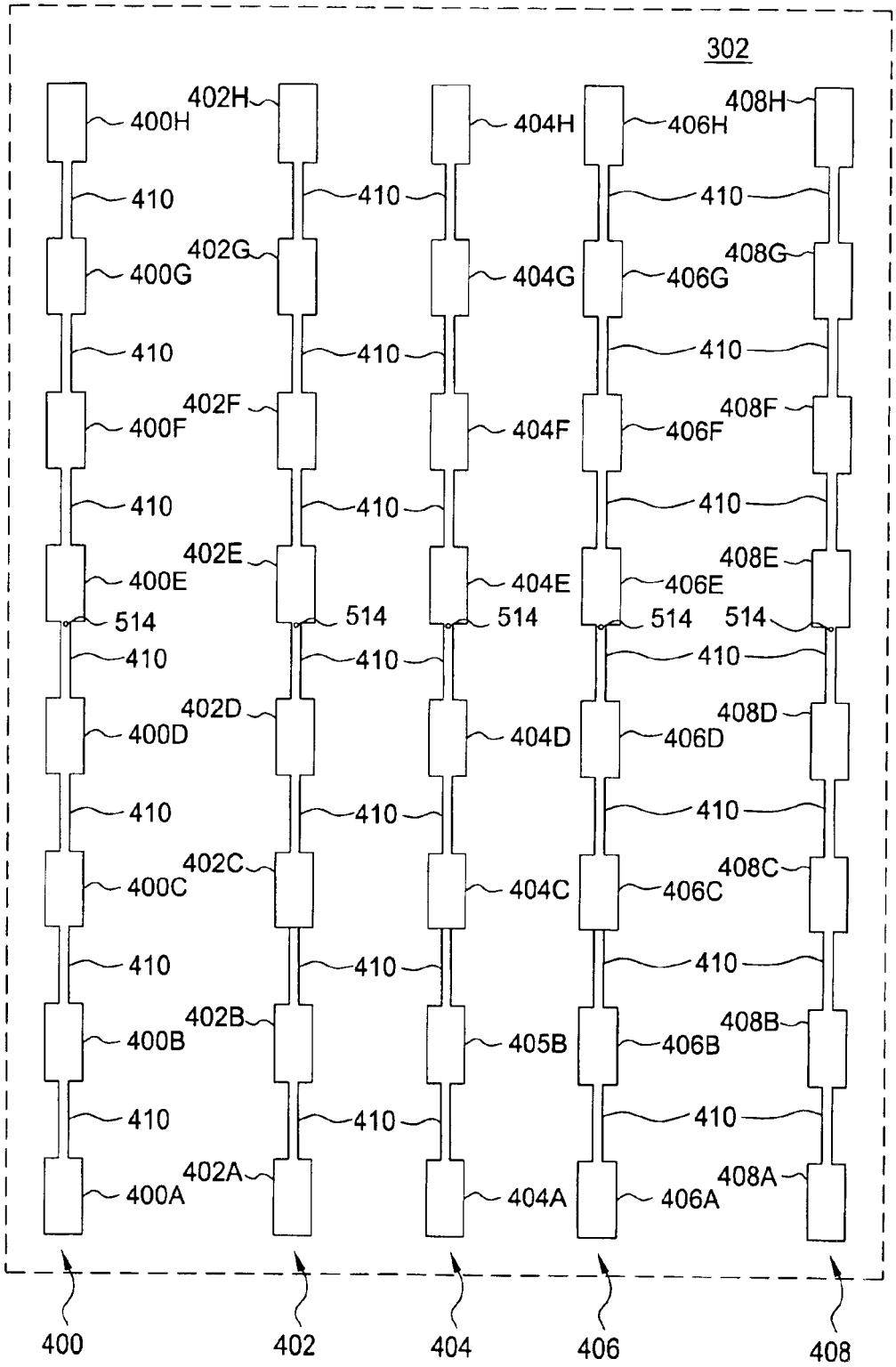
Figure 5:
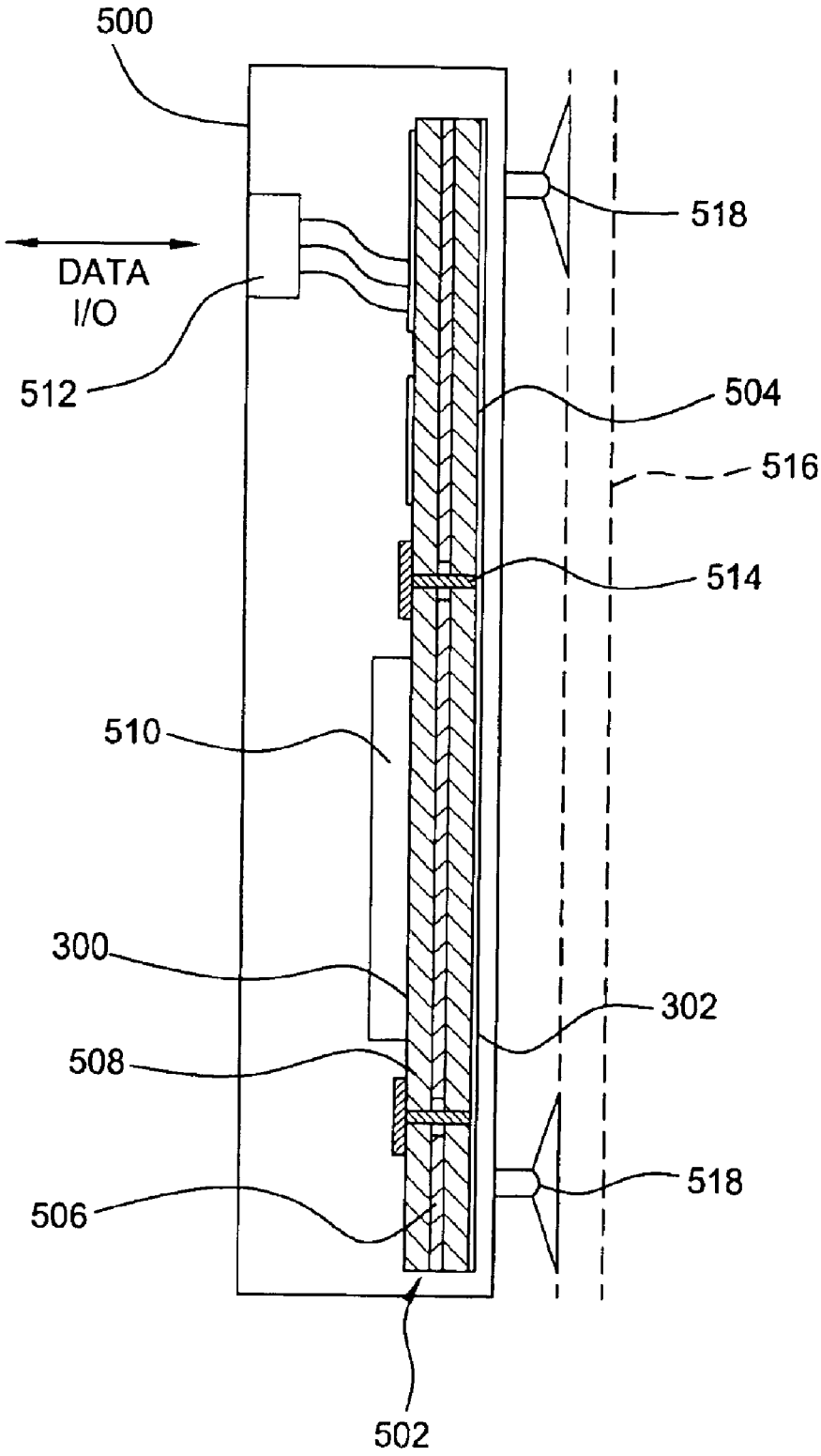
Figure 6:
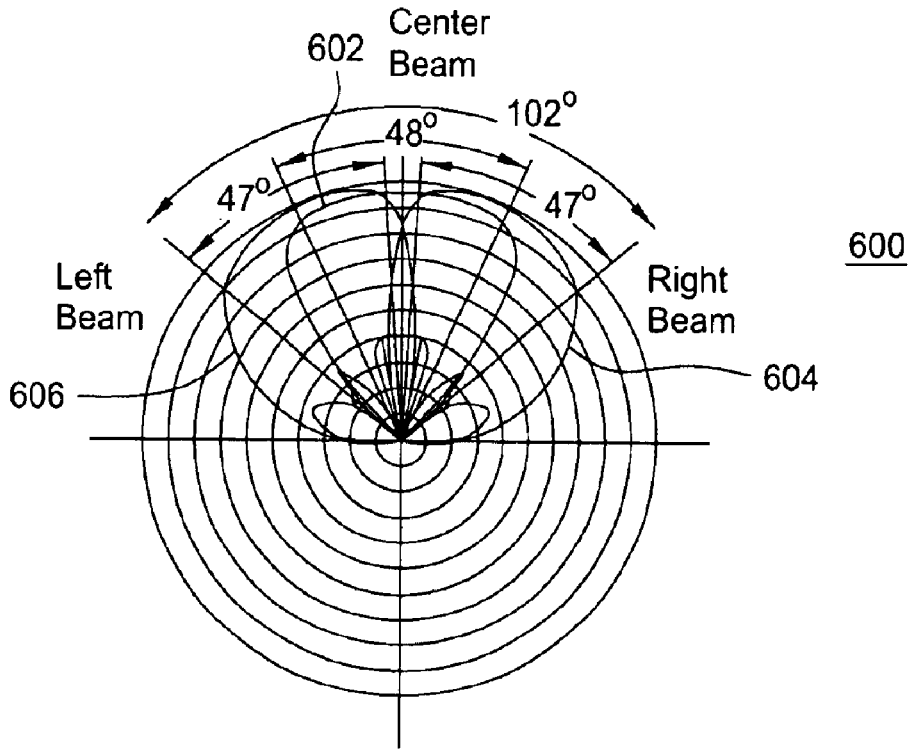

The teachings of the present invention can be readily understood by considering the following detailed description in conjunction with the accompanying drawings, in which:

FIG. 1 is a network diagram depicting an exemplary portion of a network in accordance with an aspect of the present invention;

FIG. 2A depicts an azimuth plan view of a beam produced by the antenna of the present invention;

FIG. 2B depicts an elevation plan view of a beam produced by the antenna of the present invention;

FIG. 3 depicts a block diagram of drive circuitry for the antenna array elements;

FIG. 4 depicts a plan view of the antenna array elements;

FIG. 5 depicts a vertical, cross sectional view of the antenna;

FIG. 6 depicts an azimuth pattern produced by a planar antenna of the present invention; and FIG. 7 depicts a schematic diagram of a phase shifter that is used in the drive circuitry of FIG. 3.

DETAILED DESCRIPTION

FIG. 1 is a network diagram depicting an exemplary portion of a mesh network 100 as described in commonly assigned U.S. patent application Ser. No. 10/122,886, filed Apr. 15, 2002 and application Ser. No. 10/122,762, filed Apr. 15, 2002, which are herein incorporated by reference in its entirety. Network 100 comprises network access concentrators (SNAPs) 103, network access points (NAPs) 101 and network access nodes 102. Network traffic may be routed from a network access node 102 to a neighboring network access node 102. Such a neighboring network access node 102 may route such traffic to one of its neighboring network access nodes 102 and so on until a NAP 101 or a final destination network access node 102 is reached. Notably, nodes 102 may be in communication with one another but not with any node 101 to form a private wireless network.

SNAPs 103 may be coupled to various backhauls 105, which backhauls 105 may be coupled to network 106. Network 106 may be coupled to an operations center (OC) 104. Backhauls 105 may form a part of network 106. Network 106 may comprise a portion of the Internet, a private network, or the like. By private network, it is meant a network not connected to the Internet.

NAPs 101 may be in communication with SNAPs 103 or network 106 via backhaul communication links 107. It should be understood that backhauls may be wired or wireless. In particular, backhauls coupled to NAPs 101 may have a wireless backhaul. In an embodiment, point-to-point communication is used as between a SNAP 103 and a NAP 101 in the Unlicensed National Information Infrastructure (UNII) band (e.g., using a frequency of about 5.8 Ghz). Though, at locations where wired connectivity is available, wired connectivity may be used.

Network access nodes 102 are in wireless communication with at least one NAP 101 or node 102. It should be understood that nodes 102 or NAPs 101 may be configured for any of or some combination of broadcasting, point-to-point communication, and multicasting. By broadcasting, it is meant transmitting without singling out any particular target recipient among a potential audience of one or more recipients. By point-to-point communication, it is meant transmitting with singling out a particular target recipient among a potential audience of one or more recipients. By multicasting, it is meant transmitting with singling out a plurality of particular target recipients among a potential audience of recipients. For purposes of clarity, communication between nodes 102, between NAPs 101, or between a NAP 101 and a node 102, described below is done in terms of point-to-point communication.

In one embodiment, this is accomplished using radio communication in the UNII band. However, other known bands may be used. Nodes 102 form, at least in part, a Wide Area Network (WAN) using in part wireless interlinks 108. More particularly, IEEE 802.11a physical and link layer standards may be employed for communication in a range of 9 to 54 megabits per second (Mbits/s).

Communication slots as described herein are time slots with associated frequencies. However, one of ordinary skill in the art will understand that other types of communication spaces may be used, including without limitation codes, channels, and the like.

The nodes of 102 may utilize both rooftop antennas 112 or a panel mount antenna 110 (i.e., a substantially planar antenna that is adapted to be mounted to a wall or window. The panel mount antenna 100 is capable of communicating with any mesh node 102 that is within line-of-sight to mounting location of the antenna 110.

FIG. 2A depicts a top plan view of the panel mount antenna 110 communicating with neighboring nodes 102A, 102B and 102C. While this figure shows communications with a signal neighbor node in each of the three possible beams, more than one neighbor node may reside in any of the beams. FIG. 2B depicts a side view of panel mount antenna 110 communicating with rooftop node 102B. As shall be described below, the panel mount antenna 110 synthesizes a single, directional beam that may be switched in a multitude of directions to connect to various nodes 102 within the neighborhood as well as avoid interference sources that may exist in the neighborhood. For example, panel mount antenna 110 may communicate with node 102B using a beam that is directed perpendicular from the face of the antenna 110. In other instances, the beam may be shifted to communicate with other neighboring nodes 102A or 102C as described below.

In one embodiment of the invention, the panel mount antenna 110 does not actively control the elevation of the beam, i.e., the elevation of the beam is fixed to point at a right angle from the face of the antenna. However, the neighboring rooftop nodes are typically at a slight elevation relative to the panel mount antenna. Although the panel mount antenna has a vertical beamwidth that is sufficient to receive signals from nodes at a slight elevation relative to the panel mount antenna, to maximize the signal strength coupled to a rooftop mounted antenna, the panel mount antenna 110 may be tilted either physically or electrically. Empirical study indicates that an elevation of approximately five degrees is sufficient. In alternative embodiment, the beam elevation may be electronically controlled in the same manner as the azimuth direction is controlled, as described below.

FIG. 3 depicts a block diagram of the antenna 110. The antenna 110 comprises a power delivery circuit 300 coupled to a plurality of array elements 302. The power delivery circuit 300 is mounted on one side of a circuit board and the array elements are mounted on the opposite side of the circuit board. FIG. 4 depicts a top plan view of the array elements 302. FIG. 5 depicts a vertical, cross sectional view of the antenna 110. To best understand the invention, the reader should simultaneously view FIGS. 3, 4, and 5 while reading the following description of the invention.

The power delivery circuit 300 comprises a power divider 304, a plurality of attenuators 306, 308, 310, 312 and 314, and at least one pair of phase shifters 316 and 318. The input power to the array is applied to terminal (e.g., port) 324, which has, for example, a 50-ohm input impedance. In one embodiment of the invention, the antenna operates at approximately 5.8 GHz (e.g., frequencies in the UNII band). The power from port 324 is divided by the power divider 304 into five paths 305A–E, (i.e., a 1:5 power splitter). To ensure proper side lobe attenuation relative to the main beam of the antenna 110, each output from the power divider contains attenuation (a thinning of the stripline) to adjust the relative amplitudes of the signals. To maintain a low cost, the attenuation is produced in this fixed manner. Four of the signals are then applied to phase shifters 316, 318, 320 and 322. The center signal (path 305C) is not phase shifted and forms a phase reference for the other paths 305A, B, D, E.

To provide a low cost antenna, the phase shifters 316, 318, 320 and 322 operate by shifting the signals in discrete quantities using PIN diodes to vary the coupling within a hybrid coupler. FIG. 7 depicts a schematic diagram of one of the phase shifters 316. The other phase shifters 318, 320 and 322 have the same structure. The exemplary phase shifter 316 comprises a hybrid coupler 700 and four PIN diodes 702A, 702B, 702C, 702D (collectively diodes 702). The diodes are spaced from one another along the branches 706A and 7069 by an eighth of a wavelength and spaced from the cross arms 704A and 704B of the coupler 700 by an eighth of a wavelength. The diodes 702 can be selectively biased by control signals to form a short to ground. In one embodiment of the invention, the phase shifters utilize the four PIN diodes 702 to shift the signal +90°, −90° or 0°. To facilitate phase shift selection, a control circuit 320 provides a bias voltage to the PIN diodes 702. When no bias is applied and the diodes form open circuits, the phase shift from input to output of the coupler 700 is −90 degrees. When diodes 702B and 702C are shorted to ground by biasing them, the phase shift through the coupler 700 is +90 degrees and, when diodes 702A and 702D are shorted to ground by biasing them, the phase shift through the coupler 700 is 0 degrees. These three discrete phase shifts may be applied to each of the four signal paths 305A, B, D, E. The shifted signals are applied to the array elements 302 through vias in the circuit board (see FIG. 5 below).

FIG. 4 depicts one embodiment of an arrangement for the antenna elements within the array 302. This embodiment comprises five active columns 400, 402, 404, 406 and 408. Each column 400, 402, 404, 406, and 408 comprises eight elements 400A–H, 402A–H, 404A–H, 406A–H, and 408A–H. Each element is a radiating patch. The number of elements in the column determines the vertical beam width of the antenna. More or less than 8 elements may be used in a column. Furthermore, in other embodiments of the invention, another type of radiating element, such as a slot, dipole or other aperture, could be used. Each element in a column is connected to a neighboring element by a conductor 410. Microwave power is coupled to/from each column using a via 514 (shown in FIG. 5) that is centrally located along the columns 402, 404, 406, 408. In the embodiment of the invention, each column is spaced one half wavelength from an adjacent column. Other column spacings could be used with some degradation in the beam pattern side-lobes, one half wavelength spacing provides the optimum side-lobe levels.

Though five columns are used, the embodiment can logically be considered to be a seven-column array where the "phantom" columns between 400 and 402 or between 406 and 408 have infinite attenuation and are not printed on the panel. This provides the performance of a seven-column antenna using the complexity and cost of a five-column circuit.

In an embodiment of the invention used in the UNII band, column 400 is spaced about 5.17 cm from column 402, while columns 402, 404 and 406 are spaced from one another by about 2.59 cm and column 408 is spaced from column 406 by about 5.17 cm. The elements within each column are equally spaced from one another by about 3.1 cm. Each element has the dimensions of about 0.9 cm by 1.4 cm. The size of each patch and the spacing between patches is wavelength dependent and would be scaled to design an antenna to other frequency bands.

The phase shifters 316, 318, 320 and 322 control the phase of the signal applied to each of the columns such that the antenna beam may be shifted in the horizontal plane (azimuth), but is fixed in the vertical plane (elevation). As described above, to facilitate maximizing the signal strength coupled to rooftop nodes, the vertical spacing between the elements may be adjusted to provide a slight inclination to the main beam of the antenna pattern.

FIG. 5 depicts a vertical, cross sectional view of the antenna 110. The antenna 110 comprises an enclosure 500 having a thickness of about 3 cm that houses a substrate, e.g., a multi-layer circuit board 502. The enclosure may be less than 3 cm thick depending upon the circuit configuration. Within the circuit board 502, the first layer 504 of metallization comprises the antenna elements 302, the second layer 506 of metallization comprises a ground plane and the third layer 508 comprises the driver circuit 300. A via 514 conductively couples each column of antenna elements 302 to their respective driver circuits 300. The third layer 508 also could support the transceiver and modem circuits 510. As such, the antenna sends and receives microwave communications signals via the antenna elements, processes the signals within the transceiver/modem circuits and provides data input and output at port 512. The antenna 110 can be affixed to a window 516 via suction cups 518 or other form of adhesive. In a wall-mounted configuration, the antenna may be affixed to a wall using screws or bolts. The technique used to mount the planar antenna 110 can be adapted to any type of mounting configuration.

The material and thickness between layers 504 and 506 and between 508 and 506 are important to the antenna performance (i.e., the spacing of the antenna elements and microwave circuits from the ground plane effects the operation of the circuits and the pattern of the antenna). In one embodiment of the invention, the circuit board material is a low loss material useful for fabricating microwave circuits. One type of low cost material is available from Roger's Corporation as Material RO4003. This material provides a dielectric constant such that the circuit board for operation in the UNII band is 0.032 inches thick, as measured from the ground plane to the antenna elements. The total circuit board thickness is 0.065 inches. The total circuit board size is 7 inches by 10 inches. As such, the enclosure 500 has the approximate dimensions of 3 cm thick by 25 cm tall by 20 cm wide—a size that, when installed in a window, may easily be hidden behind a curtain.

In an alternative embodiment, the antenna elements 302 of the first layer 504 may be separated from the ground plane 506 by a foam core or by an air gap. The drive circuitry can then be assembled on a conventional printed circuit board and mounted to the ground plane on the opposite side of the antenna elements. Such a foam core or air gap based circuit construction will further lower the cost of the panel mount antenna.

In the final design of the antenna structure, the spacing of the elements in the horizontal and vertical planes as well as the amplitude attenuation provided by the attenuators within the drive circuitry are adjusted to compensate for the impedance of the glass (or other material) against which the antenna is mounted.

In the embodiment where the phase shifters provide +90, −90 and 0 degree phase shifts, the single main beam of the antenna can be switched +/−45° as well as the center. As such, the antenna can be actively pointed toward the neighboring nodes to communicate with specific nodes as well as avoid unwanted interference from nodes that it is currently not communicating with as well as other microwave sources of interference.

FIG. 6 depicts the azimuth pattern 600 of the planar antenna 110 having the configuration described above for operation in the UNII band. The pattern 600 comprises a center beam 602, a right beam 604 and a left beam 606. The antenna 110 has a directive gain of 18.5 dBi with an elevation beamwidth of about 10 degrees and a azimuth beamwidth of about 47 degrees. The bandwidth of the antenna is 150 MHz.

While foregoing is directed to the preferred embodiment of the present invention, other and further embodiments of the invention may be devised without departing from the basic scope thereof, and the scope thereof is determined by the claims that follow.

What is claimed is:

1. An antenna for communicating with a mesh network comprising:

a multi-layer circuit board having a first side and a second side, with a ground plane formed within the multi-layer circuit board;

an antenna array, affixed to the first side of the multi-layer circuit board, having M×N array of antenna elements, where M and N are integers greater than 1, said antenna array adapted to selectively synthesize one or more radiation patterns for communicating with neighboring nodes of said mesh network;

a driver circuit, affixed to the second side of the multi-layer circuit board, having a power divider that divides an input microwave signal into M signal paths, a plurality of phase shift circuits are coupled to M−1 paths and the output of each phase shift circuit is coupled to an antenna element, one of the M signal paths is coupled directly to an antenna element.

2. The antenna of claim 1 wherein M is 5 and N is 8.

3. The antenna of claim 1 wherein the phase shift circuits comprise switched hybrid couplers that, in response to a control signal, phase shift the signals on the M−1 paths by a discrete phase amount.

4. The antenna of claim 3 wherein the discrete phase shift is at least one of −90 degrees, 0 degrees and +90 degrees.

5. The antenna of claim 4 wherein the discrete phase shifts cause a main beam of a radiation pattern formed by the array to be directed 0 degrees, +45 degrees and −45 degrees.

6. The antenna of claim 1 further comprising a modem circuit and a transceiver circuit.

* * * * *